US007225656B2

(12) United States Patent
Hofmann et al.

(10) Patent No.: US 7,225,656 B2
(45) Date of Patent: Jun. 5, 2007

(54) PROCESS FOR FORMING A WORKPIECE AND ROLLING MACHINE

(75) Inventors: Guenter Hofmann, Coburg (DE); Stelios Katsibardis, Coburg (DE); Siegfried Hausdoerfer, Mitwitz (DE); Henry Zwilling, Sonneberg (DE); Guenther Vogler, Roedental (DE); Herbert Rueger, Schneckenlohe (DE)

(73) Assignee: Langenstein & Schemann, GmbH, Coburg (DE)

( * ) Notice: Subject to any disclaimer, the term of this patent is extended or adjusted under 35 U.S.C. 154(b) by 117 days.

(21) Appl. No.: 10/792,388

(22) Filed: Mar. 4, 2004

(65) Prior Publication Data

US 2004/0231380 A1 Nov. 25, 2004

(30) Foreign Application Priority Data

Mar. 4, 2003 (DE) ..... 103 09 536
Apr. 28, 2003 (DE) ..... 103 19 258

(51) Int. Cl.
*B21D 15/00* (2006.01)

(52) U.S. Cl. ..... 72/108; 72/10.1; 72/10.3; 72/7.1; 72/104

(58) Field of Classification Search ..... 72/10.1, 72/10.2, 10.3, 13.4, 20.1, 99, 100, 102, 104, 72/108, 7.1
See application file for complete search history.

(56) References Cited

U.S. PATENT DOCUMENTS 3,208,257 A 9/1965 Holub
3,731,510 A 5/1973 Tsukamoto et al.
4,020,664 A 5/1977 Koizumi et al.
4,820,947 A 4/1989 Beisiegel et al.
5,339,669 A * 8/1994 Cretin et al. ..... 72/108
5,528,917 A * 6/1996 Bajraszewski et al. ..... 72/10.6
5,918,495 A * 7/1999 Miyamoto et al. ..... 72/108
6,418,767 B2 * 7/2002 Shinbutsu et al. ..... 72/10.2
2001/0039820 A1 11/2001 Shinbutsu et al.

FOREIGN PATENT DOCUMENTS

| | | |
|---|---|---|
| DE | 1477088 | 4/1969 |
| DE | 2131300 | 12/1971 |
| DE | 19526071 A1 | 1/1997 |
| EP | 1256399 A1 | 11/2002 |
| GB | 1242154 | 8/1971 |
| GB | 2002274 A | 2/1979 |
| JP | 47-038752 | 12/1972 |
| JP | 02-182339 | 7/1990 |
| JP | 11-285760 | 10/1999 |
| JP | 11-285761 | 10/1999 |
| SU | 524590 | 8/1976 |
| SU | 925499 | 5/1982 |

OTHER PUBLICATIONS

Patent Abstracts of Japan of JP Pub. No. 02-182339, which was published Jul. 17, 1990.
Patent Abstracts of Japan of JP Pub. No. 11-285761, which was published Oct. 19, 1999.
Patent Abstracts of Japan of JP Pub. No. 11-285760, which was published Oct. 19, 1999.
Derwent Abstract No. XP-002328492 of SU 925499, which was published May 7, 1982.
Derwent Abstract No. XP-002328491 of SU 524590, which was published Aug. 8, 1976.
Search Report for EP App. No. 04001862.4 dated Jun. 16, 2005.
Notification of First Action in Chinese Application No. 2004100069855 (Jul. 8, 2005).
Office Action in German Application No. 103 19 258.1 no later than Sep. 25, 2003.

* cited by examiner

*Primary Examiner*—Ed Tolan
(74) *Attorney, Agent, or Firm*—The Law Office of James E. Ruland, PLC

(57) ABSTRACT

In the transverse wedge rolling machine as claimed in the invention the drive motor is a permanent magnet motor, especially a torque motor. Furthermore the rotational speed of the rollers is controlled depending on their rotary position.

24 Claims, 7 Drawing Sheets

PROCESS FOR FORMING A WORKPIECE AND ROLLING MACHINE

Figure 1:
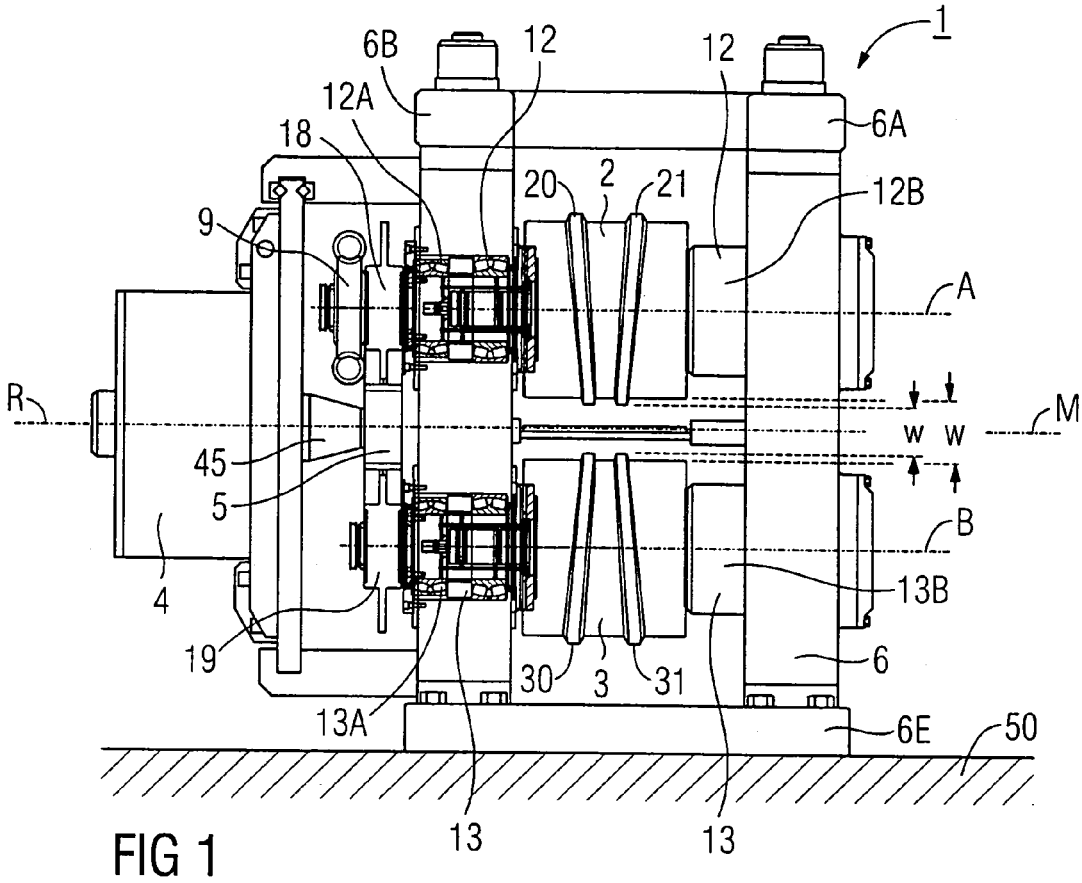

The invention relates to a process for forming a workpiece and to a rolling machine which is suitable for carrying out the process.

To form workpieces from an initial shape into a desired intermediate shape (semifinished product, preforming) or final shape (finished product, finish-forming), in addition to many other processes also rolling processes are known which are considered compression forming processes. During rolling the workpiece (rolling stock) is located between two rotating rollers and its shape is changed by application of a forming pressure by the rotating rollers. In a profile rolling process tool profiles are located on the periphery of the rollers, which enable production of the corresponding profiles in the workpiece. In flat rolling the cylindrical or conical outside surfaces of the rollers act directly on the workpiece.

With respect to the relative motion of the tools or rollers on the one hand and of the workpiece on the other, rolling processes are divided into longitudinal rolling, transverse rolling and oblique rolling. In longitudinal rolling the workpiece is moved perpendicular to the axes of rotation of the rollers in translational motion and generally without rotation through the intermediate space between the rollers (roll gap). In transverse rolling the workpiece does not move translationally with respect to the rollers or their axes of rotation, but turns only around its own axis which is conventionally the principal axis of inertia, especially the axis of symmetry for a rotationally-symmetrical workpiece. In a combination of the two types of motion in longitudinal rolling and in transverse rolling the result is oblique rolling. The rollers are generally slanted to one another and to the workpiece which is moved translationally and rotationally.

Profile transverse rolling machines in which two rollers rotate in the same direction with wedge-shaped profile tools located on the outside periphery around axes of rotation which are parallel to one another are called among others transverse wedge rollers. The tools have a wedge-shaped geometry or a geometry which is triangular in cross section and can increase in their radial dimension along the periphery and/or can run obliquely to the axis of rotation of the rollers.

These transverse wedge rollers or profile transverse rollers allow diverse forming of workpieces with high precision or dimensional accuracy. As a result of the compressive force which is applied to the workpiece by the wedge-shaped tools the distribution of material in the workpiece during rotation of the rollers is changed by a flow process in the workpiece. The wedge-shaped tools can produce peripheral grooves and other constrictions in the rotating workpiece. For example, structures and constrictions in the workpiece which change axially to the axis of rotation can be produced by the axial offset in the peripheral direction or by the oblique arrangement of the tool wedges relative to the axis of rotation. By increasing or decreasing the outside diameter of the tool wedges when running around the axis of rotation, in combination with the oblique arrangement axially running bevels and continuous transitions between two constrictions of different diameters in the workpiece can be produced. The wedge shape of the tools allows production of fine structures by the outside edges or outside surfaces of the wedges. Transverse wedge rollers are especially well suited to production of elongated, rotationally-symmetrical workpieces with constrictions or elevations such as cams or ribs.

The compressive forming force and the forming temperature are dependent on the material comprising the workpiece and on the requirements for dimensional accuracy and surface quality after forming. Especially for iron and steel tools, forming is conventionally carried out in rolling at high temperatures in order to attain the formability or flowability of the material which is necessary for forming. These temperatures which occur especially in forging can be in the range of room temperature for so-called cold forming, for semicold forming between 550° C. and 750° C. and for so-called hot forming above 900° C. The forming or forging temperature is ordinarily also placed in a temperature range in which recovery and recrystallization processes take place in the material and also undesirable phase transformations are prevented.

Transverse wedge rolling machines (or profile transverse rolling machines) are known in which the workpieces at the start of the rolling process are positioned by a positioning means which comprises two positioning carriers (so-called guiding side guards) into an initial position between the two rollers which corresponds ordinarily to the geometrical center or the center of the roll gap. At this point the positioning carriers of the positioning means are pulled back so that the workpiece turns freely between the rollers and is squeezed into the desired shape between the tools. After this rolling or squeezing process and the corresponding completion of the workpiece the workpiece is acquired via a recess in the rotating rolling tool and ejected.

DE 1 477 088 C discloses a transverse wedge rolling machine for transverse rolling of bodies of revolution or flat workpieces with two working rollers which rotate in the same direction of rotation and with wedge tools which are interchangeably located on their rolling surfaces. The wedge tools each have reduction strips which are roughened by knurling or in some other way, which rise from the roller shell to a vertical end point matched to the workpiece to be manufactured, and which run in the shape of a wedge or a triangle, and smooth forming surfaces with a calibration effect which run at the same distance to the roller jacket. The wedge tools are made as deformation segments and run only over the partial periphery of the pertinent roller surface. On the workpiece the surfaces and tools of the two working rollers, which surfaces and tools face one another, move in opposite directions to one another.

EP 1 256 399 A1 discloses a transverse rolling machine with two modules which are operated in parallel, that is, modules of two rollers at a time which rotate in the same direction of rotation, and which have tools which are made in the shape of half shells with radially projecting tool wedges on their peripheral surface, the forming of a workpiece requiring only rotation around half the periphery of a roller pair. All four rollers are driven by only one drive motor via one gear train unit and drive shaft connected in between.

DE 195 26 071 A1 discloses a device for rolling profiles into a workpiece, especially transverse rolling, longitudinal rolling and oblique rolling of threads, knurling, tooth rolling profiles or the like, with two forming rollers which are rotated in the same direction around axes of rotations which are parallel to one another and are driven each by the pertinent drive with a drive motor, a braking means being assigned to each drive.

DE 21 31 300 B discloses a transverse rolling machine with two profile rollers which are located axially parallel horizontally over one another for forming and cutting to length rotationally symmetrical workpieces in which the profile rollers touch the workpieces at peripheral points which are diametrically opposite one another and the lower profile roller has a recess for routing the rolled and cut workpieces out of the roll gap.

The object of the invention is to devise a new process for forming of workpieces and a new rolling machine with which the process can be carried out.

This object is achieved with respect to the process as claimed in the invention.

The process for forming the workpiece comprises the following process steps:

a) placement of the workpiece between at least two rotating rollers provided (equipped) with tools and
b) setting (controlling) the rotational speed, especially the angular velocity, rpm or peripheral speed of at least one of the rollers depending on the rotary position of at least one of the rollers.

The term "forming" is defined here as any conversion of the shape of a workpiece into other shape, as was also described above, including preforming and finish-forming.

The object is achieved with respect to the rolling machine as claimed in the invention.

The rolling machine is suited and also intended for carrying out a process as claimed and comprises at least one permanent magnet motor, especially a torque motor, for driving the rollers.

The rolling machine is suited and also intended for carrying out a process as claimed and comprises for each of the rollers the pertinent drive, the drives being independent of one another.

An advantageous embodiment and development of the process and of the rolling machine follow from the claims which are dependent.

In the first embodiment, the dependency of the rotational speed of the rollers on the rotary position of the roller(s) is or has been chosen depending on the machined workpiece. To do this, the optimum characteristic of the rotational speed which is matched to the workpiece is determined beforehand and then set when the workpiece is formed.

The process generally comprises at least three process steps or process phases. In the first process phase the workpiece is positioned between the rollers. In the second process phase the workpiece is formed between the rotating tools of the rollers. In a third process phase the workpiece is removed or ejected again from the intermediate space between the rollers. Over the duration of these three process phases of course the angle of rotation or the angular position of the rollers also changes continuously.

The rotational speed can now be varied in different process phases and/or also within one process phase.

In one version of the process the rotational speed of the rollers in the first process phase is chosen at least on average to be lower than during the second process phase.

In one alternative or additional version the rotational speed of the rollers during the second process phase is chosen at least on average to be greater than during the third process phase. Preferably the workpiece is automatically positioned between the rollers during the first process phase by a positioning means.

At the start of the second process phase the workpiece is acquired preferably by a recess in the tools of at least one roller and then during the second process phase is rolled between the tools of the two rollers. The rotational speed is increased in one advantageous embodiment after acquisition of the workpiece by the recess in the tools of the roller(s).

Preferably at the start of the third process phase the workpiece is further acquired by a recess in the tools of at least one roller and is ejected from the intermediate space between the rollers. Before acquisition of the workpiece by the third recess in the roller(s) the rotational speed of the rollers is preferably reduced.

The rotational speeds when the workpiece is acquired at the start of the second process phase and when the tool is acquired at the end of the second process phase are especially roughly the same.

In one preferred embodiment the rotational speed during the second process phase is kept at least partially constant.

The rotational speed of the roller(s) can however also be changed in the second process phase, especially when several tools on the roller work in succession machine the workpiece in different partial process phases of the second process phase. For example the rotational speed at the start of the partial process phase can be reduced.

The rotational speed can also be kept at least partially constant during the first process phase and the positioning of the workpiece.

The rotational speed and/or the direction of rotation of the rollers is or are set, preferably for the most part, essentially equal to one another at least in angle intervals or time intervals, but can also be set to be different from one another at least in sections.

The current rotary position of the roller(s) can be determined by computation from the initial position or reference position of the roller(s) and the characteristic of the rotational speed. Preferably however the rotary position of the roller(s) is determined by at least one position detection means. The position detection means comprises preferably at least one angular position incremental transducer or an absolute value detector and/or an optical, magnetic, inductive or ultrasonic angular position transducer.

In one especially advantageous embodiment the rolling machine is a profile transverse rolling machine or a transverse wedge rolling machine. As a result of the rpm-controllable and reversible drive the rolling machine or the transverse wedge rolling machine can also be used as a stretch rolling machine or, in short, a stretch roller.

The permanent magnet motor accelerates preferably to the rated rpm for operating the rollers within an angle of rotation of a maximum 3°, 2.2°, 1° or 0.5°. Furthermore the permanent magnet motor preferably has a rated torque between roughly 5000 Nm and roughly 80,000, especially between roughly 35,000 Nm and roughly 60,000 Nm and/or a rated rpm between roughly 20 rpm and 800 rpm, especially roughly 30 rpm or 500 rpm.

In one development of the rolling machine the drive encompasses, besides at least one permanent magnet motor, at least one gear train for transfer of the torque or the rotary motion of the permanent magnet motor to at least two rollers. The gear train encompasses especially at least one central driving gear which is coupled to the driven shaft of the permanent magnet motor and two roller gears which are coupled to one of the rollers at a time and which are engaged or can be caused to engage the driving gear. The transmission ratio of the gear train from the drive motor to each of the rollers is then generally the same and is chosen to be preferably in the range between 1:1 and 1:1.5. This drive is therefore especially mechanically synchronized via the gear train.

In addition to drives with PM motors, roller drives can also be hydraulic drives and/or electric drives with other motors, especially with synchronous or asynchronous motors and/or induction motors. In independent drives for the rollers conversely the rollers are electronically synchronized or controlled, especially via converters which for example convert a line voltage of 400 V and 50 Hz into an AC voltage or an alternating current of suitable amplitude and frequency. Here it is especially advantageous that for transverse wedge rollers the force load on the two motors due to the symmetrical structure of the tools/rollers and/or of the symmetrical forming process is comparatively low and thus synchronization of the drives is promoted.

The invention is further explained below using embodiments. Reference is made to the following schematics.

Figure 2:
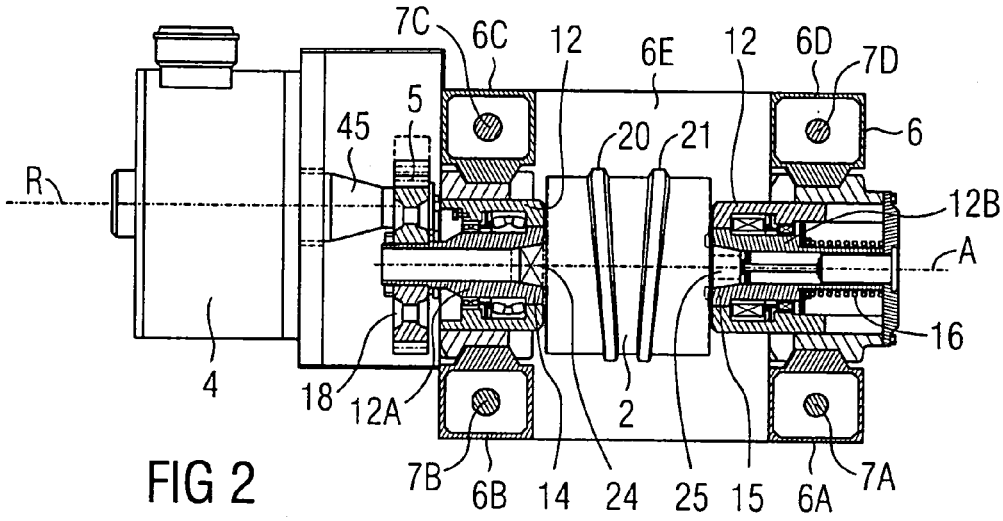
Figure 3:
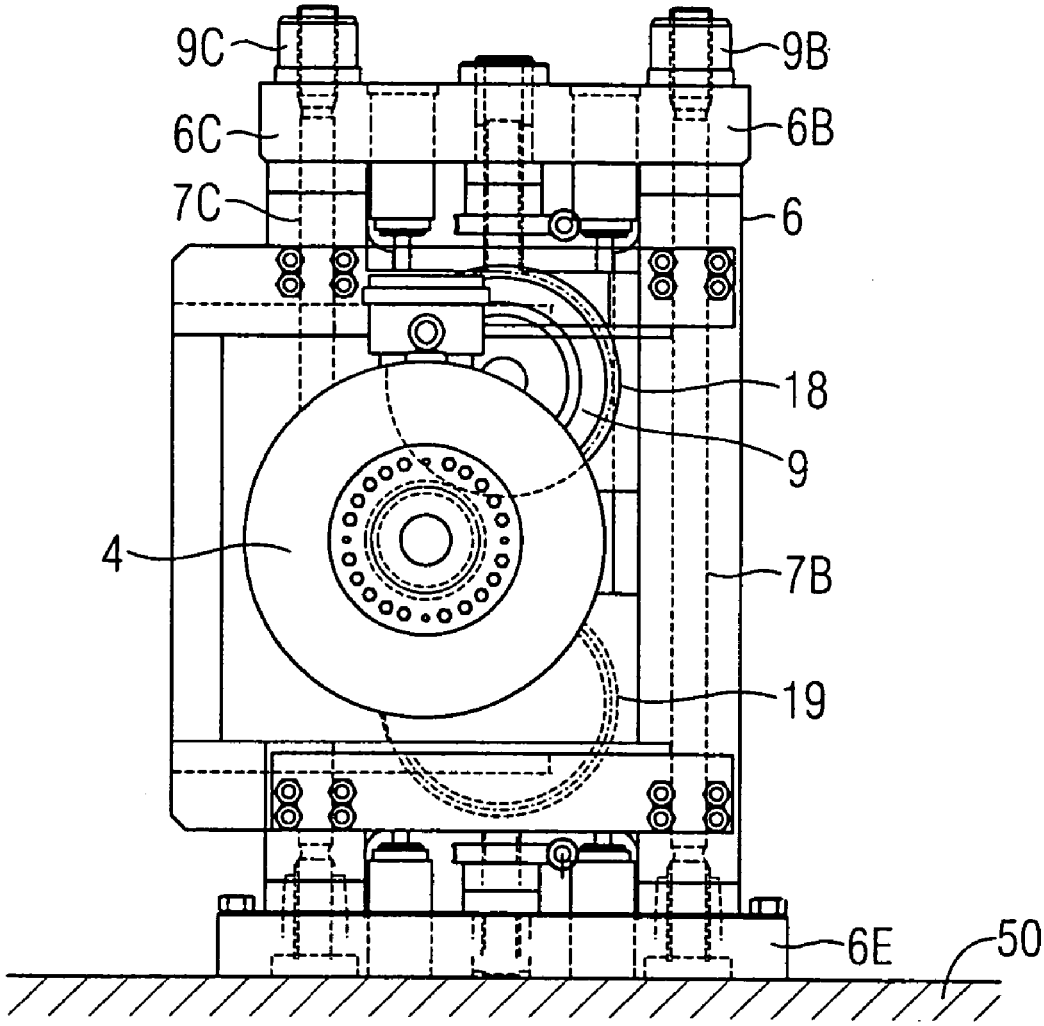
Figure 7:
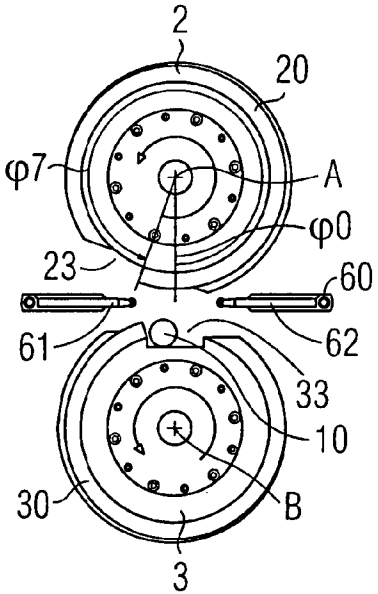
Figure 6:
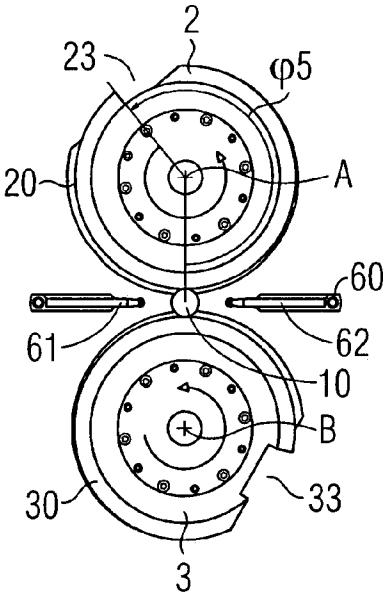
Figure 5:
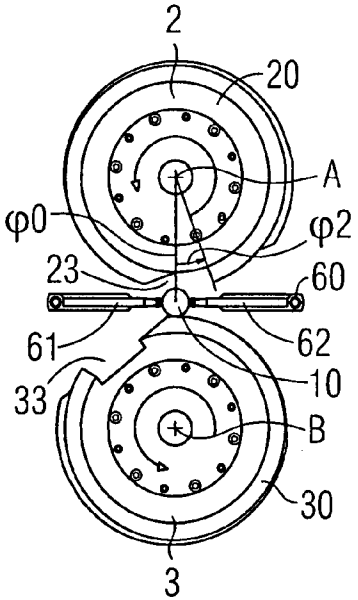
Figure 4:
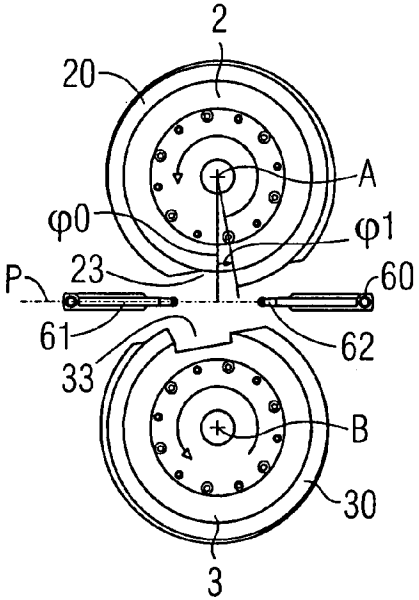
Figure 8:
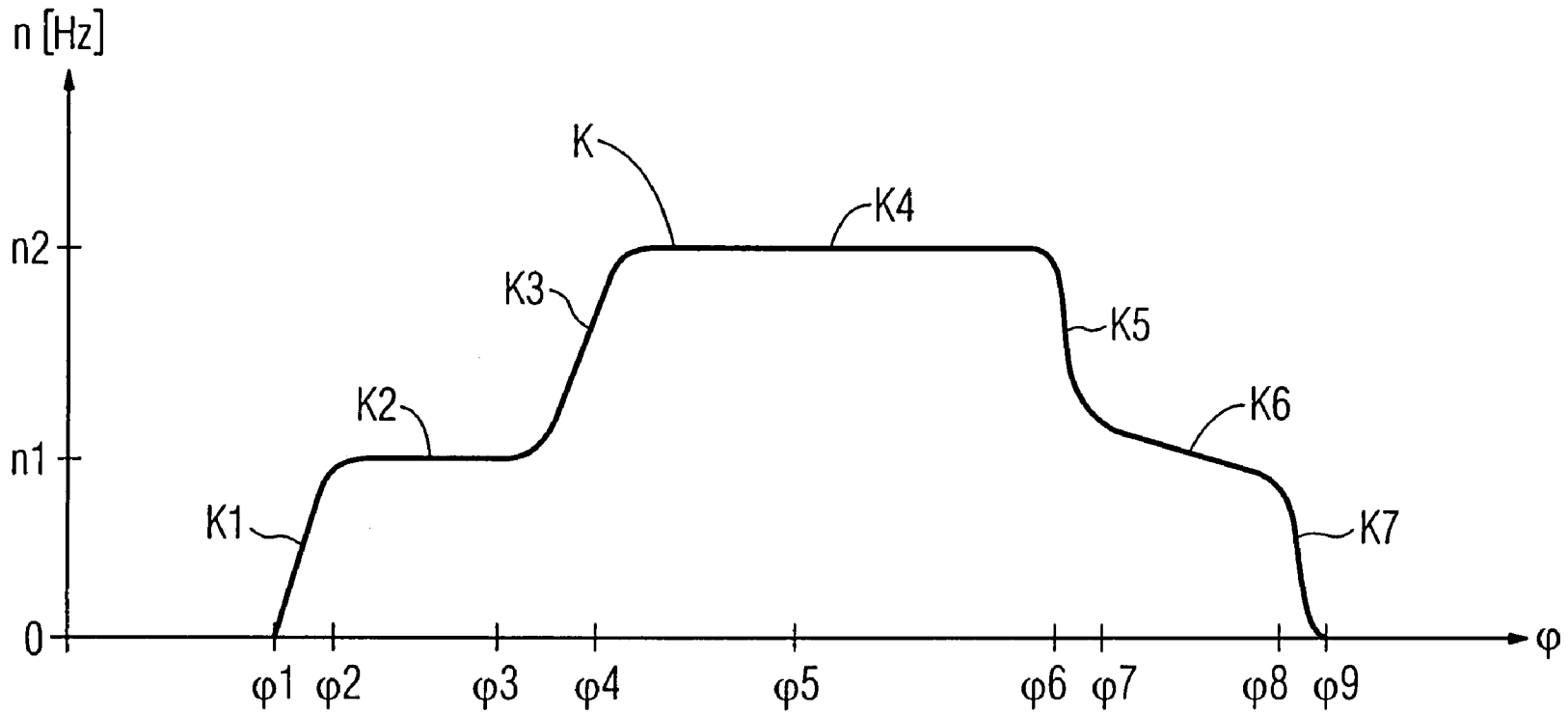
Figure 9:
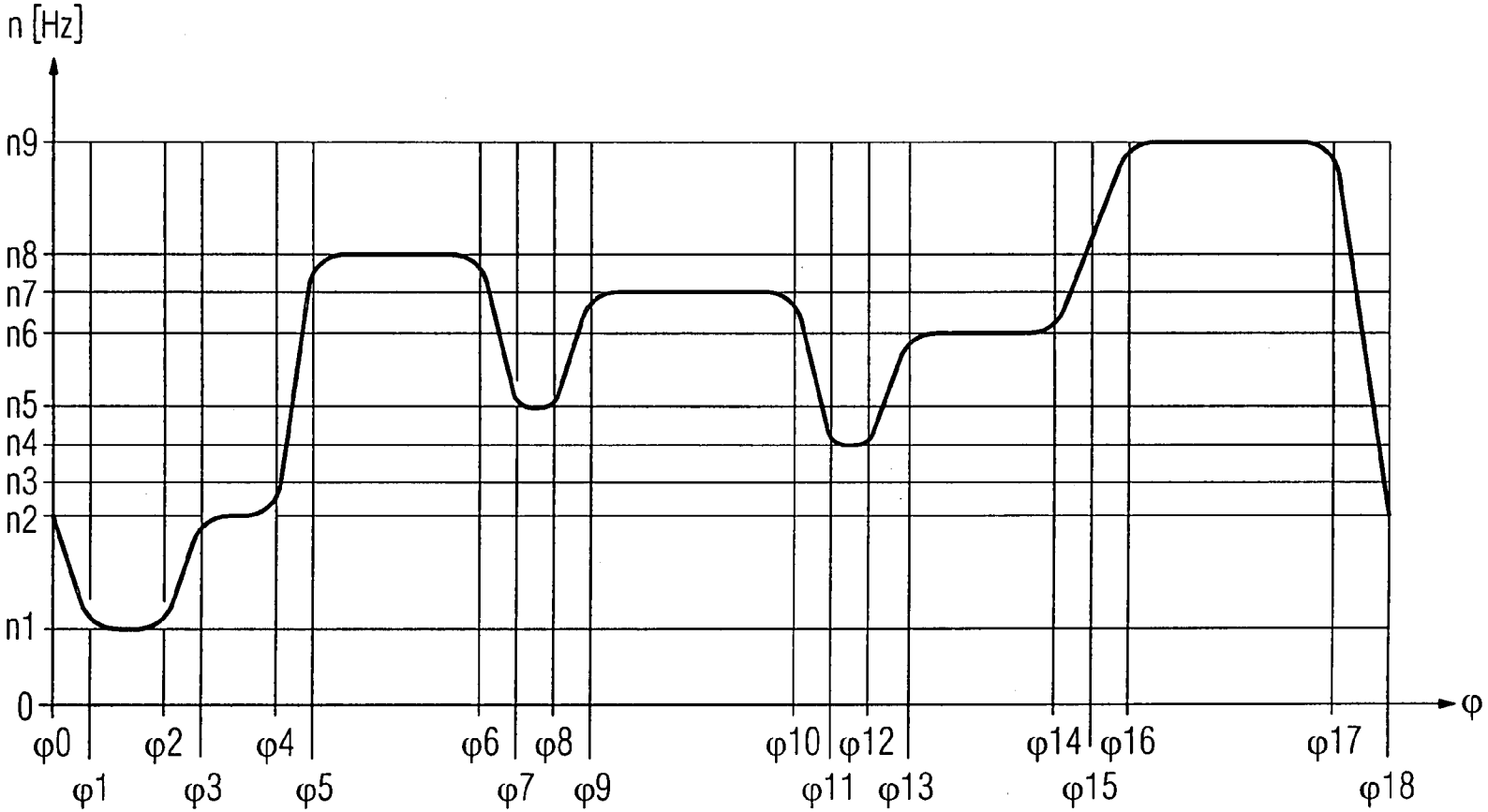
Figure 10:
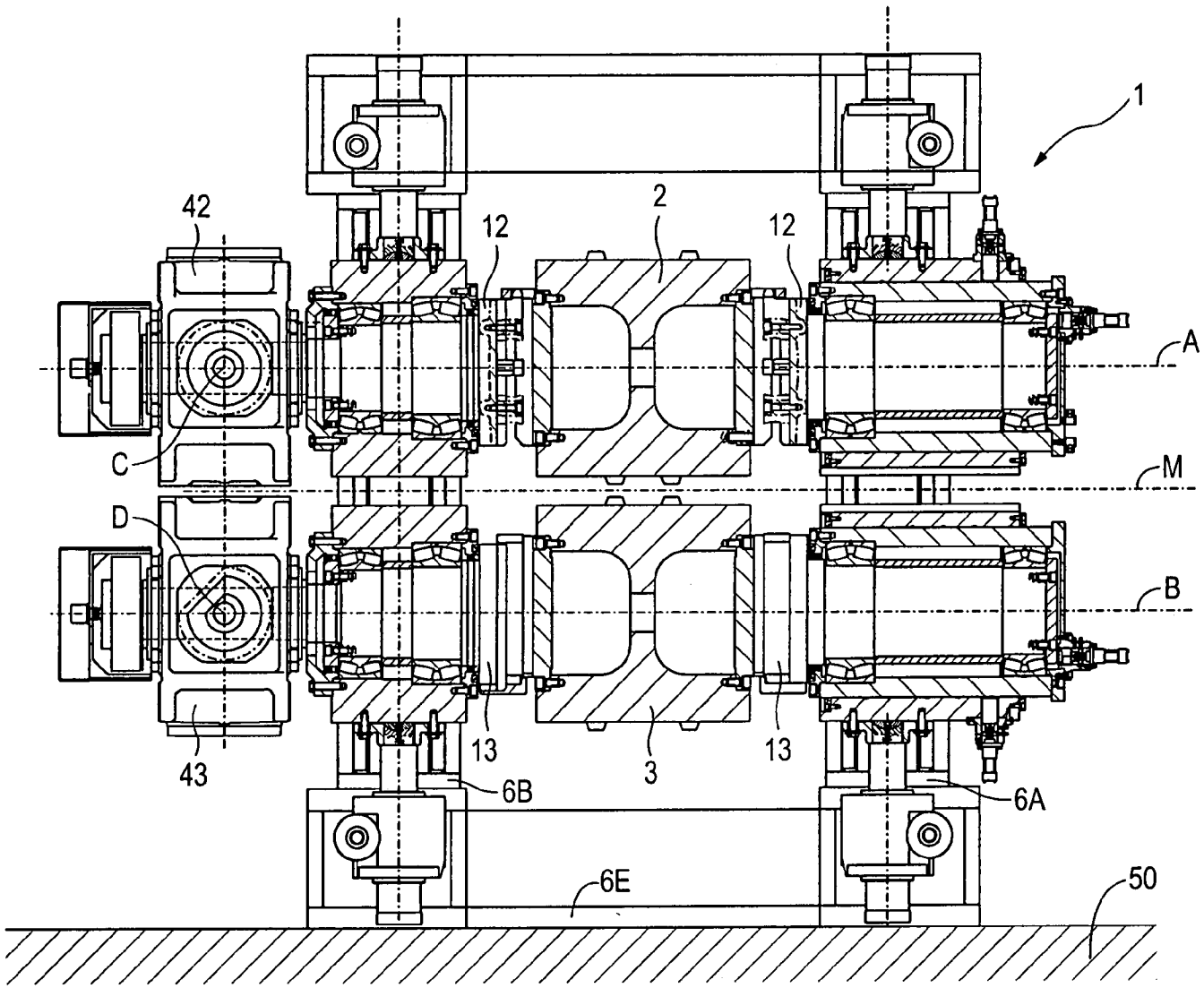
Figure 11:
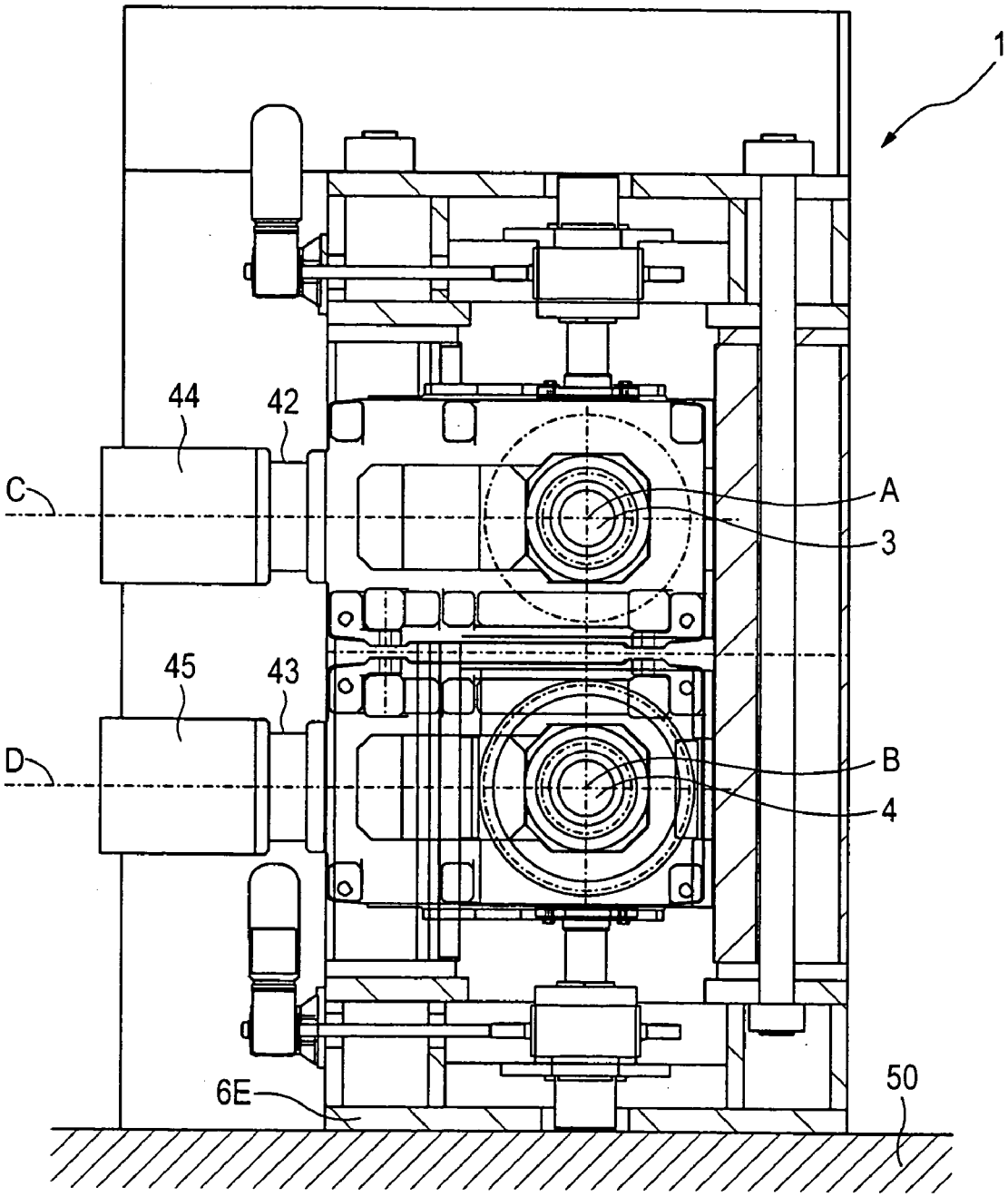

FIG. 1 shows a rolling machine with two rollers and a common drive in a partially cutaway lengthwise view, FIG. 2 shows the rolling machine as shown in FIG. 1 in partially cutaway overhead view, FIG. 3 shows the rolling machine as shown in FIG. 1 and FIG. 2 in a side view, FIG. 4 shows the two working rollers of a rolling machine in a cross section before the workpiece is inserted, FIG. 5 shows the two working rollers of a rolling machine when the workpiece is inserted, FIG. 6 shows the working rollers with a machined workpiece in a cross section, FIG. 7 shows the two working rollers when the workpiece is ejected and FIG. 8 shows the possible relationship between the angular speed of a working roller and the angle of rotation in a diagram, FIG. 9 shows another possible relationship between the angular speed of a working roller and the angle of rotation in a diagram, FIG. 10 shows one embodiment of a rolling machine with two rollers and independent drives for rolling in a partially cutaway lengthwise view and FIG. 11 shows the rolling machine as shown in FIG. 10 in a side view.

Parts and quantities corresponding to one another are provided with the same reference numbers in FIGS. 1 to 11.

The embodiment of a rolling machine 1 which is made as a transverse wedge roller or a transverse wedge rolling machine shown in FIGS. 1 to 3 comprises a first working roller 2 which is rotating or can be rotated around an axis A of rotation and a second working roller 3 which is rotating or can be rotated around an axis B of rotation. The direction of rotation of the two working rollers 2 and 3 is illustrated with the arrows shown and is the same. The axes of rotation A and B are essentially parallel to one another, in the example of FIGS. 1 to 3 viewed in the direction of the force of gravity on top of one another so that the working rollers 2 and 3 are also located on top of one another. The working rollers have an essentially cylindrical outside surface. The distance between the cylindrical outside surfaces of the two working rollers 2 and 3 is labelled W.

Tools 20 and 21 and 30 and 31 which are each wedge-shaped in cross section are attached, especially braced to the outside surface or the shell surface of the working rollers 2 and 3. In the embodiment shown the tools 20 and 21 of the first working roller 2 and the tools 30 and 31 of the second working roller 3 are each located obliquely and at an angle to the respective axis A and B of rotation, the tools 20 and 21 of the working roller 2 being located axially in essentially the same positions with respect to the center axis M which defines the geometric center and which runs between the two rollers parallel to the axes of rotation. The tools 20 and 21 and 30 and 31 increase in their cross section viewed in the peripheral direction, the increase of the cross section for the tools 20 and 21 being in the same direction of rotation or orientation and for the tools 30 and 31 of the second working roller 3 oppositely or in the opposite direction to that for the tools 20 and 21 of the first working roller 2.

Each working roller 2 and 3 is detachably held in a holding means consisting of two parts and can be removed from the holding means in its unlocked state for replacement of the tools 20 and 21 and 30 and 31 or of the working rollers 2 and 3 in their entirety with the tools 20 and 21 and 30 and 31. The holding means for the working roller 2 is labelled 12 and the holding means for the working roller 3 is labelled 13. The first part 12A of the holding means 12 located on the left in FIGS. 1 and 2 comprises a conical receiver 14 for holding a truncated extension 24 (shaft end) which extends axially to the axis A of rotation A to the outside from the working roller 2. The second part 12B accordingly comprises a receiver 15 for holding a corresponding extension 25 of the working roller 2, which extension runs axially to the axis A of rotation and which tapers conically away from the working roller 2. Under the resulting wedge and clamping action the working roller 2 is braced securely in the receivers 14 and 15 of the holding means 12, the axial force on the receiver 15 in the direction of the axis A of rotation A toward the working roller 2 for holding the working roller 2 being produced by a spring 16 or other element which applies an axial force. The receivers 14 and 15 are made rotationally symmetrical to the axis A of rotation and are supported in rotary bearings which are not detailed.

The receiver 14 continues as a hollow shaft axially to the axis A of rotation and in its end area facing away from the working roller 2 have a toothed gear 18 which in the same manner as the corresponding toothed gear 19 which is assigned to the second working roller 3 engages a control gear (pinion gear, driving gear) 5. The toothed gear 18 which is used to drive the first working roller 2 via the holding means 12 fits from overhead into the control gear 5 and the toothed gear 19 which is coupled to the second working roller 3 via the holding means 13 fits from underneath into the control gear 5.

The control gear 5 is now coupled via driven shaft 45 to a drive motor 4. The control gear 5, the driven shaft 45 and the rotor of the drive motor 4, which rotor is not shown, are rotating or can be rotated around a common axis R of rotation. The drive which is composed of the drive motor 4, the driven shaft 45 and the control gear 5 for the toothed gears (roller gears) 18 and 19 and thus the working rollers 2 and 3 which turn synchronously with the toothed gears 18 and 19 is thus a direct drive.

The mechanical output provided by the drive motor 4 corresponds to the product of the torque and angular velocity or angular frequency $\omega$, the angular frequency $\omega$ being equal to the product of $2\pi$ and the rpm n. The drive motor 4 is preferably a torque motor and has a high torque even at a comparatively low rpm n of the drive motor 4 for producing the required drive output for the drive rollers 2 and 3.

The transmission ratio from the control gear 5 to the toothed gears 18 and 19 can thus be selected to be in the range around 1, especially between roughly 1:1 and roughly 1:2. At a transmission ratio of 2 the drive rollers 2 and 3 turn twice as fast as the control gear 5 and the drive motor 4, at a transmission ratio of 1:1 exactly as fast. Typical rpm of the working rollers 2 and 3 are between roughly 10 revolutions per minute (rpm) and roughly 40 rpm, typically 15 rpm.

With such a low speed drive motor 4 or one which turns with low rpm at this point, very dynamic matching or control of the rpm of the working rollers 2 and 3 can be accomplished.

One preferred embodiment of the drive motor 4 is a permanent magnet motor in which there are permanent magnets, generally on the rotor, which produce a magnetic flux which turns in the induction field of the stator which has been generated by electromagnets or windings, by the interaction of the magnetic flux of the permanent magnets and the induction field rotation of the rotor arising based on the induction principle or electromotive principle. Generally a torque motor is a synchronous motor, i.e. the rotor turns synchronously with the rotating magnetic flux. The induction windings of the stator are generally associated with the phases of a three-phase connection and are located offset by 120° to one another. Preferably permanent magnets with an energy product as high as possible are used, for example rare earth-cobalt magnets. The stator for this purpose generally has an iron core with a three-phase winding packet, while the rotor has a cylindrical iron core with permanent magnets. Such a torque motor can have a torque of up to 80,000 Nm. The high torque also causes very rapid rotary acceleration. In particular the permanent magnet motor or torque motor can accelerate the rollers within a rotary angle of only 1°, preferably even only 0.5°, to the nominal rpm, for example 30 rpm. This high dynamics or rotary acceleration of the torque motor allows very dynamic control of the rpm.

The control of the rpm n of the working rollers 2 and 3 which rotate synchronously to one another as claimed in the invention is now matched to the rolling process with a special control process. To do this, the rpm n or the angular velocity ω of the working rollers 3 and 3 are matched to the respective rotary position or angular position ϕ of the working rollers 2 and 3 and controlled depending on this rotary position ϕ. Thus, depending on the respective process, the respective rolling machine and mainly depending on the workpiece to be machined, the forming by the working rollers 2 and 3 can be optimized by controlling the rpm n or the angular velocity $\omega = d\phi/dt$.

FIGS. 4 to 7 now show one possible sequence of a rolling process with such a rotary position-dependent rpm control for a workpiece 10. A positioning means for the workpiece 10 is labelled 60 and comprises two positioning parts (guiding side guards) 61 and 62 which can move relative to one another.

FIG. 4 shows the position of the working rollers 2 and 3 before insertion of the workpiece. The identical directions of rotation of the two rollers 2 and 3 around the respective axes A and B of rotation are labelled with the corresponding arrow. There is a recess 23 in the tool 20 which runs in segments around the outside surface of the working roller 2 and around the axis A of rotation. In the second working roller 3 there is likewise another recess 33 in the segment-like tool 30.

The workpiece 10 is moved by means of two guiding side guards of a positioning means which is not detailed into a position between the working rollers 2 and 3 in which it is acquired by the recess 23 in the tool 20 of the first working roller 2. This process phase with the tool 10 inserted in the initial position is shown by FIG. 5. On the workpiece 10 the facing surfaces of the working rollers 2 and 3 move in opposite directions to one another.

As the working rollers 2 and 3 continue to turn to one another the workpiece 10 is moved between the tools 20 and 30, and under the pressure of the tools 20 and 30 which have a shorter distance w to one another than the original diameter of the workpiece 10, is taken into a smaller diameter. The reduced diameter (pass) of the workpiece 10 which has arisen after forming at the point shown in cross section corresponds largely to the minimum distance w between the tools 20 and 30 of the working rollers 2 and 3. FIG. 6 shows the position of the working rollers 2 and 3 with the squeezed workpiece 10 in between during the actual rolling process.

FIG. 7 finally shows the position of the working rollers 2 and 3 in which the workpiece 10 falls into the recess 33 of the tool 30 of the second working roller 3 and as the working roller 3 continues to turn is ejected from the intermediate space between the working rollers 2 and 3.

Therefore, in the rolling process, basically three process phases can be distinguished, specifically a first process phase for preparation of the rolling process and positioning of the workpiece in the initial position, therefore the process phase which is shown in FIGS. 4 and 5, furthermore a second process phase, during which the actual rolling process takes place and the workpiece is formed between the tools of the two working rollers, as shown in FIG. 6, and finally a third process phase during which the workpiece is again removed from the tools, as shown in FIG. 7.

FIG. 8 shows a diagram in which the rpm n of the working rollers 2 and 3 is plotted as a direct measure for the rotational speed in the unit of measurement hertz (Hz)=1/s or given in revolutions per second (or also revolutions per minute) over the rotary position or the rotary angle ϕ of the working roller 2. Nine successive angular positions ϕ1 to ϕ9 are plotted on the ϕ axis and between the angular positions ϕ1 and ϕ9 the rpm n are plotted as a function n (ϕ) of the angle of rotation ϕ. The resulting curve is labeled K. This curve K is in turn divided into seven component curves K1 to K7, the first component curve K1 running between the angular positions ϕ1 and ϕ2, the second component curve K2 running between the angular positions ϕ2 and ϕ3, the third component curve K3 running between the angular positions ϕ3 and ϕ4, the fourth component curve K4 running between the angular positions ϕ4 and ϕ5, the fifth component curve K5 running between the angular positions ϕ5 and ϕ6, the sixth component curve K6 running between the angular positions ϕ6 and ϕ7, and the seventh component curve K7 running between the angular positions ϕ7 and ϕ8. The first component curve K1 and the second component curve K2 show one possible time characteristic of the rpm n of the working rollers 2 and 3 in the first process phase which is between the angular positions ϕ1 and ϕ3 for preparation and positioning of the workpiece 10. Between the angular positions ϕ1 and ϕ2, in a rather steep rise according to component curve K1 the rpm is increased from 0 to a first rpm n1>0 and then is kept essentially constant between the angular positions ϕ2 and ϕ3 according to the component curve K2. In the time interval between ϕ2 and ϕ3 according to the component curve K2, the workpiece 10 is positioned between the working rollers 2 and 3 and finally is acquired roughly at the angular position ϕ3 by the recess 23 of the tool 20 of the first working roller 2.

The angular position ϕ3 is the angular position of the first rotary roller 2 in which the workpiece 10 is fixed in the recess 23 and the rolling process can begin. Let it be noted here that the angular position or rotary position of the second working roller 3 is directly correlated with the angular position of the working roller 2 and changes synchronously, but in the opposite direction with the angular position of the first working roller, the rotation of the working rollers 2 and 3 taking place in the same direction to one other. Therefore it is sufficient to examine the rotary position of the first working roller 2. Of course the angular position of the second working roller 3 could be taken in exactly the same way as a variable or parameter on which the rpm n is made dependent. In any case it is sufficient to provide on one of the two working rollers 2 or 3 a position detection means for determining the rotary angle $\phi$ relative to the reference or zero position $\phi 0$ which is chosen and drawn in FIGS. 4 to 7 to the bottom.

When the angular position $\phi 3$ is reached and the workpiece 10 locks into the recess 23, the rpm n between the angular position $\phi 3$ and the following angular position $\phi 4$ is quickly increased in the curve section K3 with a correspondingly high rotary acceleration or rise of the characteristic line K. At the angular position $\phi 4$ then a high rpm n2 is reached at which the rpm n is kept during the component curve K4 up to a new angular position $\phi 6$. This component curve K4 between the angular positions $\phi 4$ and $\phi 6$ marks the actual rolling process. FIG. 6 shows a snapshot of this rolling extract for the angular position $\phi 5$ of the working roller 2.

Shortly before the recess 33 of the tool 30 of the second working roller 3 reaches the workpiece 10, at an angle $\phi 6$ of the first working roller 2, which angle is in front of the pertinent angular position $\phi 7$ of the first working roller 2, the rpm n is again reduced during the component curve K5, preferably again with a high braking acceleration, and then further reduced with lower braking acceleration according to the flatter rise in the component curve K6 between the angular positions $\phi 7$ and $\phi 8$. Therefore the workpiece is ejected at lower rpm n and lower rotary acceleration in order to eject the workpiece carefully. The ejection of the workpiece is ended at the end of the component curve K6 at the angular position $\phi 8$ of the first working roller 2 and the rpm is returned again to rpm n=0 when the process of machining this workpiece 10 between the rotary angles $\phi 8$ and $\phi 9$ is ended according to the component curve K7. One working cycle or one forming process is thus ended.

Of course other angular position-dependent profiles of the rpm n can also be traversed. Thus it is also possible to turn the two working rollers 2 and 3 during the component phases of the process with different rpm or even a different direction of rotation from one another. Furthermore, the profile n ($\phi$) can be controlled depending on the number and arrangement of tools on the working rollers.

FIG. 9 shows a relationship n ($\phi$) in which a complicated profile is traversed during the forming process. First, proceeding from the angular position $\phi 0$ and rpm n=n2 braking to rpm n1 is done at the angular position $\phi 1$. These rpm n1 are maintained up to an angular position $\phi 2$ and then accelerated again to rpm n2 at the angular position $\phi 3$ and these rpm n2 are maintained up to the angular position $\phi 4$. This decrease of the rpm n is advantageous when the workpiece 10 is grasped or threaded in. For the first forming phase with a first tool between the angular positions $\phi 4$ and $\phi 5$ acceleration takes place from rpm n2 to greater rpm n8 and these rpm n8 are maintained up to an angular position $\phi 6$. Then braking takes place again from rpm n8 to rpm n5 between the angular positions $\phi 6$ and $\phi 7$. Rpm n5 are maintained between the angular positions $\phi 7$ and $\phi 8$ and then are accelerated again between $\phi 8$ and $\phi 9$ to rpm n7 which are again maintained during a plateau phase between $\phi 9$ and $\phi 10$. This plateau phase between $\phi 9$ and $\phi 10$ with rpm n7 corresponds to another forming phase with another tool. Finally, braking takes place again from rpm n7 to rpm n4 between the angular positions $\phi 10$ and $\phi 11$, rpm n4 are maintained up to the angular position $\phi 12$ and then accelerated again to rpm n6 in the interval between $\phi 12$ and $\phi 13$. The rpm n6 are kept constant up to the angular position $\phi 14$. Then acceleration takes place again to maximum rpm n9 between the angular positions $\phi 14$ and $\phi 16$ and the rpm n9 are kept between $\phi 16$ and $\phi 17$ during the last forming phase. Finally at the end of the forming process between $\phi 17$ and $\phi 18$ braking takes place to the original rpm n2. The following applies: $0<n1<n2<n3<n4<n5<n6<n7<n8<n9$.

As shown by the profiles shown in FIGS. 8 and 9, the angle-dependent rpm control as claimed in the invention allows a host of matched roller rotary motions for different processes, tools and workpieces.

FIGS. 1 and 3 furthermore show a worm wheel 9 which is coupled to the toothed gear 18 for the working roller 2 and enables setting or adjustment of the relative angular position of the working roller 2 relative to the working roller 3. Thus the angular positions of the working rollers 2 and 3 relative to one another can be set matched to different tools or also for correction.

To set or correct the tooth play or tooth engagement between the roller gears 18 and 19 and the central control gear 5 there can furthermore be an adjustment drive which is not shown and which can move the rotary drive with the permanent magnet motor 4 and the gear train with the driven shaft 45 and the control gear 5 relative to the two roller gears 18 and 19. In this way asymmetrical engagement or tooth profile play can be corrected. Furthermore it is also possible to provide separate drives for adjusting the rollers 2 and 3 with their roller gears 18 and 19 so that the tooth engagement of the rollers gears 18 and 19 to the central control gear 5 can be set independently of one another.

The holding means 12 and 13 of the two working rollers 2 and 3 are carried by a carrier means 6 and supported or anchored in it. The carrier means 6 comprises four column-like carrier elements 6A to 6D which are arranged in a rectangular arrangement and are mounted or attached to a common bottom plate 6E which is supported on the bottom 50. In each of the carrier elements 6A to 6D there is a pertinent tie rod 7A to 7B arranged vertically in the lengthwise direction of the respective carrier element which is attached underneath to the carrier plate 6E and is pretensioned above by means of a pertinent lock nut, preferably a hydraulically actuated lock nut (9B, 9C in FIG. 3). Here, under the hydraulic nut a slotted washer segment is placed when the hydraulic nut is in the loosened state and then the nut is pressed against the washer segment by applying hydraulic pressure. In this way the carrier means which forms the frame of the rolling machine can be placed at a certain tensile stress. This leads to stiffening of the roll stand.

FIGS. 10 and 11 show another embodiment of a transverse wedge rolling machine 1 in which, in contrast to the embodiment shown in FIGS. 1 to 3, a first drive 42 for the first working roller 2 and a second drive 43 which is independent of the first drive 42 for the second working roller 3 [sic]. Each drive 42 and 43 comprises the pertinent permanent magnet motor 44 and 45 and a gear train which is not detailed, for example, especially a three-stage toothed gear train for transfer of the torque of the motor to the pertinent working roller 2 and 3. The reduction ratio of each gear can be for example 1:35. In the embodiment shown in FIGS. 10 and 11 the axis C of rotation of the driven shaft of the permanent magnetic motor 44 of the first drive 42 and the axis D of rotation of the driven shaft of the permanent magnet motor 45 of the second drive 43 are pointed orthogonally to the axes A and B of rotation of the respective working rollers 2 and 3 and the motors are accordingly arranged laterally on the roll stand.

Each of the permanent magnet motors 44 and 45 is triggered electronically, especially via a converter. In this way the working rollers 2 and 3 can be driven either electronically synchronously or also synchronously.

REFERENCE NUMBER LIST

1 rolling machine
2,3 working roller
4 drive motor
5 control gear
6 carrier means
6A to 6D carrier element
6E bottom plate
7A to 7D tie rod
8A to 8D guide
9 worm wheel
9B, 9C lock nut
10 workpiece
12 holding means
12A, 12B part
13 holding means
13A, 13B part
14, 15 receiver
16 spring
18, 19 toothed gear
20, 21 tool
23 recess
24, 25 extension
30, 31 tool
33 recess
42, 43 rotary drive
45 driven shaft
46, 47 rotary driving gear train
50 bottom
60 positioning means
61, 62 positioning parts
A, B axis of rotation
C, D drive axis
G force of gravity
M center axis
P positioning axis
R axis of rotation
w tool distance
W roller distance Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by weight, unless otherwise indicated.

The entire disclosures of all applications, patents and publications, cited herein and of corresponding German application No. 10309536.5, filed Mar. 4, 2003, and German application No. 10319258.1, filed Apr. 28, 2003 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. Process for forming a workpiece, comprising:

a) the workpiece is located between at least two rotating rollers which are equipped with tools;

b) the rotational speeds of the rollers are set or controlled essentially the same to one another;

c) a rotary position of the roller(s) is detected by at least one position detection means; and d) the rotational speed of the rollers is controlled depending on a detected rotary position of at least one of the rollers according to a previously determined relationship between the rotational speed and the rotary position;

e) wherein the relationship between the rotational speed and the rotary position of the roller(s) is chosen depending on a machined workpiece.

2. Process as claimed in claim 1, wherein the workpiece a) is positioned during a first process phase between the rollers, b) during a second process phase is formed between the tools of the rollers and c) during a third process phase is removed or ejected again from the intermediate space between the rollers.

3. Process as claimed in claim 2, wherein the rotational speed in the first process phase is at least on average less than during the second process phase.

4. Process as claimed in claim 2, wherein the rotational speed of the rollers during the second process phase is at least on average greater than during the third process phase.

5. Process as claimed in claim 2, wherein the workpiece is positioned during the first process phase by a positioning means between the rollers.

6. Process as claimed in claim 2, wherein the workpiece at the start of the second process phase is acquired by the tool or tools of at least one roller and is formed during the second process phase between the tools of the two rollers and at the start of the third process phase is ejected from the intermediate space between the rollers.

7. Process as claimed in claim 5, wherein the rotational speed is increased after acquisition of the workpiece by the tools of the roller(s) in the second process phase.

8. Process as claimed in claim 5, wherein the rotational speed is reduced before ejecting the workpiece in the third process phase.

9. Process as claimed in claim 5, wherein the rotational speed when the workpiece is acquired is roughly the same at the start of the second process phase and at the end of the second process phase.

10. Process as claimed in claim 2, wherein the rotational speed of at least one of the rollers is kept at least partially constant during the second process phase.

11. Process as claimed in claim 2, wherein the rotational speed of the rollers is changed during the second process phase.

12. Process as claimed in claim 2, wherein the second process phase comprises individual component process phases during which the workpiece is formed by different tools on the rollers, before or after one component process phase and/or between the component process phases and/or during the component process phases the rotational speed being changed.

13. Process as claimed in claim 12, wherein the rotational speed is reduced before at least one or before each component process phase.

14. Process as claimed in claim 1, wherein the direction of rotation of the rollers is set essentially the same to one another at least in terms of phase.

15. Process as claimed in claim 1, wherein the rotational speed in at least one rotary position is reduced in order to prevent overstressing of the workpiece in this rotary position.

16. Process as claimed in claim 1, wherein the rotational speed for at least one rotary position is controlled such that the torque exerted on the pertinent roller in this rotary position assumes or does not exceed a given value.

17. Process as claimed in claim 1, wherein the current position of the tools on the rollers is determined and the reference rotary position of the rollers is set depending on the determined current position of the tools.

18. Process as claimed in claim 1, wherein the workpiece is cold-formed.

19. Process as claimed in claim 1, wherein the workpiece is semicold-formed.

20. Process as claimed in claim 1, wherein the workpiece is hot-formed.

21. Process as claimed in claim 1, wherein the workpiece consists of a ferriferous material.

22. Process as claimed in claim 1, wherein the workpiece consists of a nonferriferous metallic material.

23. Process as claimed in claim 1, wherein the rollers are driven by a common drive.

24. Process as claimed in claim 1, wherein the rollers are driven independently of one another by one pertinent drive at a time.

* * * * *